US010384085B1

(12) United States Patent
Aleksovski

(10) Patent No.: US 10,384,085 B1
(45) Date of Patent: Aug. 20, 2019

(54) CONCRETE ANCHOR POINT AND METHOD FOR CONSTRUCTING SAME

(71) Applicant: Climb Tech, LLC, Austin, TX (US)

(72) Inventor: Daniel Aleksovski, Austin, TX (US)

( * ) Notice: Subject to any disclaimer, the term of this patent is extended or adjusted under 35 U.S.C. 154(b) by 93 days.

(21) Appl. No.: 15/185,533

(22) Filed: Jun. 17, 2016

(51) Int. Cl.

| | |
|---|---|
| ***E04G 21/32*** | (2006.01) |
| ***A62B 35/00*** | (2006.01) |
| ***B28B 23/00*** | (2006.01) |
| ***E04B 1/41*** | (2006.01) |

(52) U.S. Cl.
CPC ..... *A62B 35/0068* (2013.01); *B28B 23/005* (2013.01); *E04B 1/4121* (2013.01); *E04G 21/3276* (2013.01)

(58) Field of Classification Search
CPC ..... E04G 21/3276; A62B 35/0068; E04B 1/1421; B28B 23/005
USPC ..... 52/125.5, 298, 704, 707
See application file for complete search history.

(56) References Cited

U.S. PATENT DOCUMENTS 1,045,562 A * 11/1912 Kennedy ..... E04B 1/4121 411/180
1,052,149 A * 2/1913 Kennedy ..... E04B 1/4121 248/343
1,264,189 A * 4/1918 Kreator ..... E04D 1/22 403/24
1,365,718 A * 1/1921 Ogden ..... E04B 1/4121 52/701
1,447,515 A * 3/1923 Miller ..... F16B 13/00 411/178
2,305,252 A * 12/1942 Hayden ..... E04B 1/4121 254/29 A
3,333,388 A * 8/1967 Sandin ..... E04B 1/41 52/300
3,391,514 A * 7/1968 Hall, Jr. ..... E04B 1/4107 52/699
3,405,497 A * 10/1968 McNair ..... E04B 1/4121 52/699
3,514,917 A * 6/1970 Merrill, Sr. ..... E04B 1/4121 52/704
3,561,307 A * 2/1971 Mortensen ..... E04B 1/4121 411/432
3,605,548 A * 9/1971 Mortensen ..... F16B 13/066 411/44
3,685,782 A * 8/1972 Kowell ..... B28B 23/005 249/86
4,211,048 A * 7/1980 Naka ..... E04B 1/4121 411/427

(Continued)

FOREIGN PATENT DOCUMENTS

DE 1273908 B * 7/1968 ..... E04B 1/4121
EP 1045087 A1 * 10/2000 ..... B28B 23/005

(Continued)

*Primary Examiner* — Robert Canfield
(74) *Attorney, Agent, or Firm* — Birdwell & Janke, LLP

(57) ABSTRACT

A concrete anchor point includes an internally threaded member and a spacer. The internally threaded member and the spacer are cast in a volume of concrete. The internally threaded member terminates in an open end. The spacer has a hole extending therethrough which provides a through-hole in the volume of concrete extending from the opening in the exposed face to the open end. The spacer functions to space the open end away from the exposed face at a non-zero depth within the volume of concrete.

20 Claims, 6 Drawing Sheets

(56) References Cited

U.S. PATENT DOCUMENTS

| | | | | | |
|---|---|---|---|---|---|
| 4,437,276 | A * | 3/1984 | Goldberg | B28B 7/0008 | 52/125.5 |
| 5,468,105 | A * | 11/1995 | Iwamoto | E04B 1/4121 | 411/433 |
| 6,393,795 | B1 * | 5/2002 | Irwin | F16B 13/141 | 411/82.1 |
| 8,132,389 | B2 * | 3/2012 | Gee | B28B 23/005 | 52/699 |
| 8,839,591 | B2 | 9/2014 | Guthrie et al. | | |
| 9,062,452 | B2 * | 6/2015 | Espinosa | E04B 1/4171 | |
| 2010/0326767 | A1 * | 12/2010 | Guthrie | A62B 35/0037 | 182/3 |
| 2015/0096242 | A1 * | 4/2015 | Lin | E04G 15/04 | 52/125.5 |
| 2015/0284967 | A1 * | 10/2015 | Kim | E04C 5/12 | 52/125.4 |
| 2017/0298617 | A1 * | 10/2017 | Espinosa | E04B 1/4121 | |
| 2018/0023296 | A1 * | 1/2018 | Recker | E04B 5/02 | |

FOREIGN PATENT DOCUMENTS

| | | | | |
|---|---|---|---|---|
| GB | 2034845 A * | 6/1980 | E04B 1/4121 | |
| GB | 2103749 A * | 2/1983 | E04B 1/4121 | |

* cited by examiner

Fig. 1 *(PRIOR ART)*
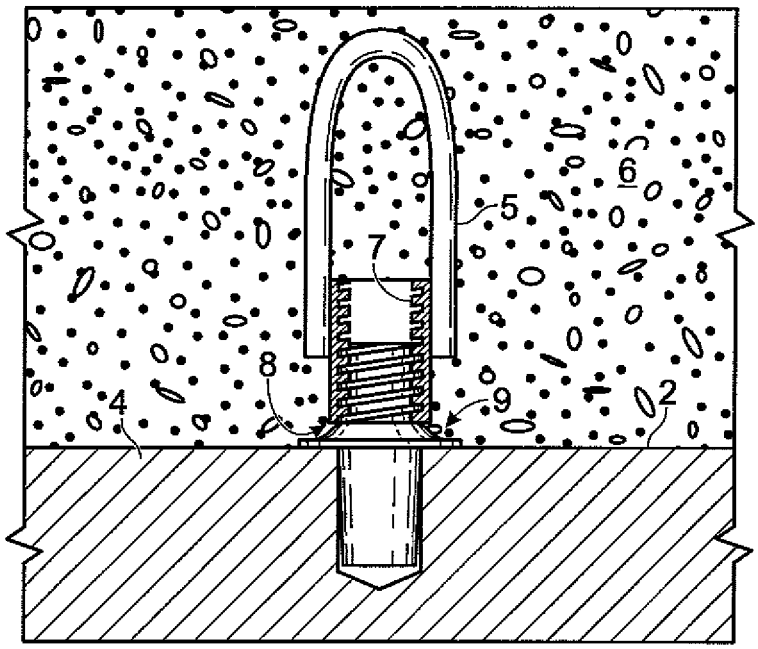
Fig. 2 *(PRIOR ART)*
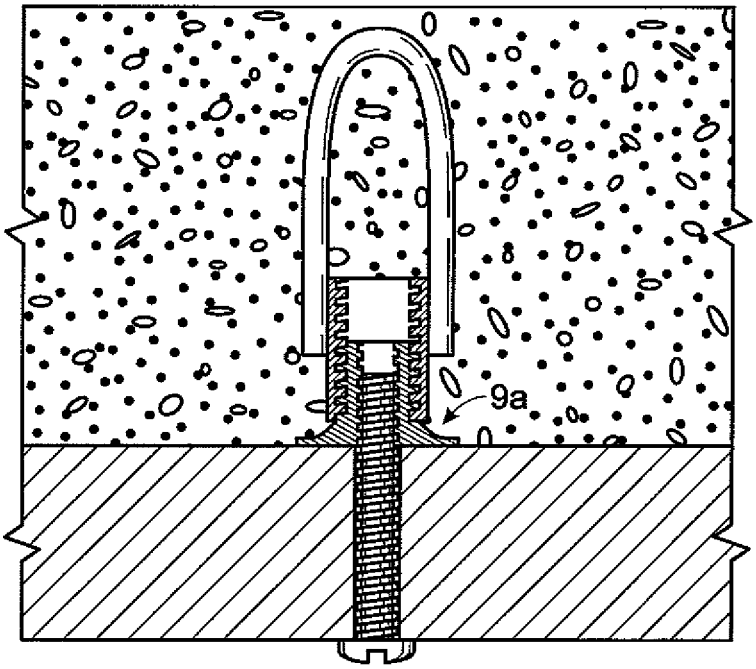

Fig. 3 *(PRIOR ART)*
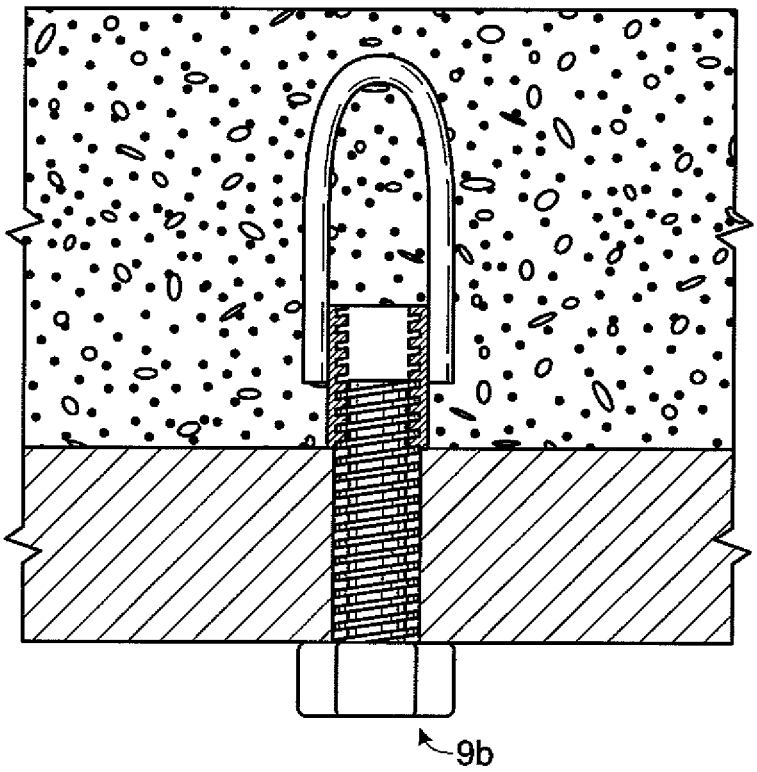

CONCRETE ANCHOR POINT AND METHOD FOR CONSTRUCTING SAME

FIELD OF INVENTION

The present invention relates to an anchor point for installation in a concrete structure, for attaching hardware that is used for tethering a worker to the structure and thereby providing for fall protection.

BACKGROUND

Hardware known as a "ferrule loop insert" is often used to make structural connection to concrete structures such as concrete walls, ceilings and floors. Referring to FIG. 1, the typical ferrule loop insert has a loop portion 5 attached to an internally threaded ferrule 7, the ferrule having an open end 8 for receiving an externally threaded member such as a bolt. By various means, the open end 8 is fitted with a plug 9 and positioned above a plywood form 4, and concrete 6 is poured over the form and the ferrule loop insert and allowed to cure. When the form is removed, the ferrule loop insert is left remaining, cast into the concrete. Removing the plug 9 from the end 8 allows for accessing the threads of the ferrule loop insert 7 for making the desired structural connection thereto. FIGS. 2 and 3 show alternative plugs 9*a* and 9*b*.

SUMMARY

A concrete anchor point and method for constructing same is disclosed herein. The disclosed concrete anchor point includes an internally threaded member and a spacer. The internally threaded member and the spacer are cast in the volume of concrete. The internally threaded member terminates in an open end. The spacer has a hole extending therethrough which provides a through-hole in the volume of concrete extending from the opening in the exposed face to the open end. The spacer functions to space the open end away from the exposed face at a non-zero depth within the volume of concrete.

A method for constructing a concrete anchor point is also disclosed. The disclosed method includes providing an internally threaded sub-assembly and a spacer.

The internally threaded sub-assembly includes an internally threaded member that terminates in an open end, and a plug. The plug has at one end thereof an externally threaded portion adapted for threading into the internally threaded member and, at an opposite end thereof, a head portion.

The spacer has first and second opposite ends and a hole extending therebetween.

The method further includes threadingly inserting the externally threaded portion of the plug into the internally threaded member through the open end, receiving, at the first end of the spacer, the head portion of the plug by said hole, disposing the second end of the spacer on a concrete form for receiving wet concrete, dispensing wet concrete over at least at least a portion of the form so as to bury the internally threaded member and spacer in a volume of concrete, and thereafter removing the form to reveal an exposed face of the volume of concrete, wherein the spacer provides a through-hole in the volume of concrete extending from the exposed face to the open end, with the spacer functioning to space the open end away from the exposed face at a non-zero depth within the volume of concrete.

The method may include providing a foundation sub-assembly having a threaded member, the threaded member of the foundation sub-assembly having at one end thereof an externally threaded portion and, at an opposite end thereof, a head portion, and fluffier include threading the externally threaded portion of the threaded member of the foundation sub-assembly into the concrete form, wherein the step of disposing includes receiving, at the second end of the spacer, the head portion of the threaded member of the foundation sub-assembly by said hole.

Where the hole defines an inner surface of the spacer associated with the second end of the spacer, the method may include providing a sealing member for the second end of the spacer between the head portion of the threaded member of the foundation sub-assembly and the concrete form, and turning the head portion of the threaded member of the foundation sub-assembly so as to compress the sealing member for the second end of the spacer against the inner surface of the spacer associated with the second end of the spacer.

The method may include interlockingly engaging the head portion of the threaded member of the foundation sub-assembly with the head portion of the plug, in which case the step of turning the head portion of the threaded member of the foundation sub-assembly may be caused by turning the plug, which in turn may be caused by turning the internally threaded member of the internally threaded sub-assembly.

Where the hole defines an inner surface of the spacer associated with the first end of the spacer, the method may include providing a sealing member for the first end of the spacer between the head portion of the plug and the open end of the internally threaded member. In such case, the method may include turning the internally threaded member relative to the plug so as to cause compression of the sealing member for the first end of the spacer against the inner surface of the spacer associated with the first end of the spacer.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

BRIEF DESCRIPTION OF DRAWINGS

FIG. 1 is a cross-sectional side elevation of a prior art ferrule loop insert buried in concrete that has been poured over a concrete form, showing a first prior art means for plugging a internally threaded portion of the ferrule loop insert for keeping the poured concrete out of the internally threaded portion.

FIG. 2 is a cross-sectional side elevation of the ferrule loop insert of FIG. 1 showing a second prior art means for plugging the internally threaded portion of the ferrule loop insert.

FIG. 3 is a cross-sectional side elevation of the ferrule loop insert of FIG. 1 showing a third prior art means for plugging the internally threaded portion of the ferrule loop insert.

DESCRIPTION OF PREFERRED EMBODIMENTS

Figure 4:
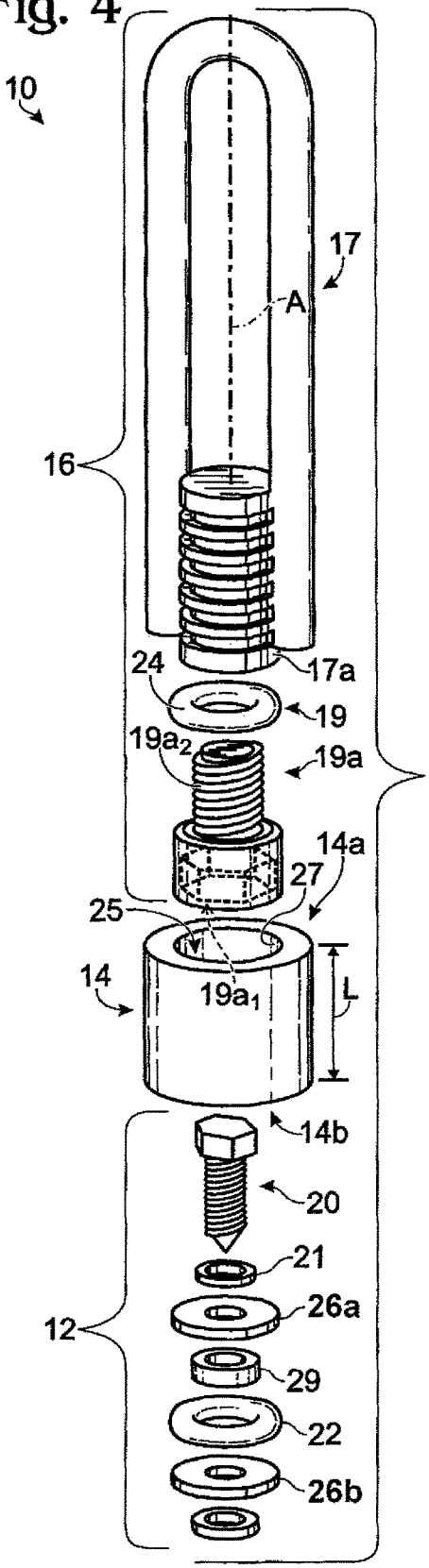
FIG. 4 is an exploded isometric view of an assembly of hardware that may be used to create a concrete anchor point according to the present invention in poured concrete.

With reference to FIG. 4, an assembly 10 of hardware that may be used to create a concrete anchor point in poured concrete according to the present invention includes a foundation sub-assembly 12, a spacer 14, and an internally threaded sub-assembly 16.

The spacer 14 has a hole 25 extending from an upper end 14*a* of the spacer through an opposite, lower end 14*b* of the spacer. The hole defines an inner surface 27 of the spacer, a portion 27*a* of which is located proximate the upper end 14*a* and a portion 27*b* of which is located proximate the lower end 14*b*.

Figure 5:
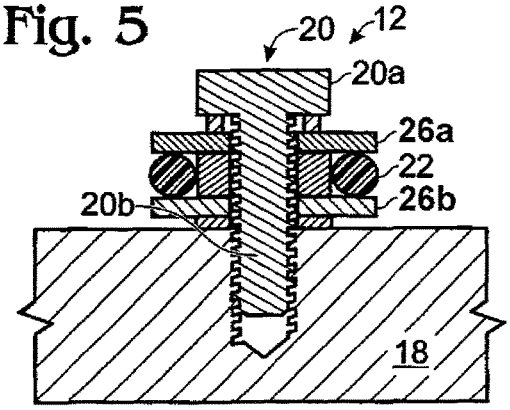
FIG. 5 is a cross-sectional side elevation of a foundation sub-assembly according to the invention disposed on a concrete form.

FIG. 5 shows the foundation sub-assembly 12 disposed on a concrete form 18 which is typically formed of plywood. The foundation sub-assembly 12 includes a foundation member for anchoring to the form, which is preferably a lag bolt 20 having a head 20*a* and a threaded end 20*b*. The foundation sub-assembly 12 also includes a sealing member 22 disposed so as to encircle the threaded end 20*b*, and two washers 26*a* and 26*b*, with the sealing member being disposed between the two washers. The sealing member 22 is preferably an O-ring, but may be a Belleville washer or any other article adapted for significant radial expansion as a result of being subjected to axial compression sufficient to provide for the sealing and support functions described further below.

Where the concrete form is plywood as is typical, the lag bolt 20 is preferably turned into the plywood without use of a pilot hole, because it is desirable to provide for a turning resistance that reduces the tendency of the bolt to loosen after it has been turned into the plywood a desired amount. The form (or "decking") may alternatively be formed of other materials such as metal, where drilling a small pilot hole may be desirable.

Figure 6:
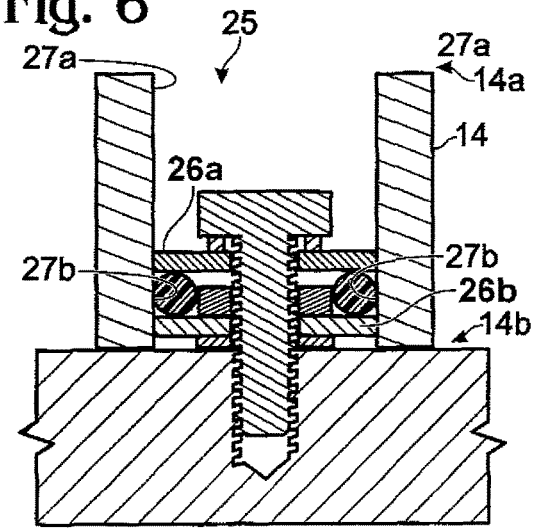
FIG. 6 is a cross-sectional side elevation of a spacer according to the invention disposed over the foundation sub-assembly of FIG. 5.

The lag bolt 20 is first turned into the plywood just far enough to avoid squeezing the two washers together against the sealing member. Then, with reference to FIG. 6, the spacer 14 is disposed over the head of the lag bolt. If, for example, the sealing member is an O-ring, the O-ring and spacer are adapted so that the outer diameter of the O-ring is larger than the diameter of the inner surface 27*b* of the spacer, so that the O-ring makes an interference fit with the spacer sufficient to effectuate a seal therebetween without need for axial (i.e., along the axis "A" in FIG. 1) compression.

If, for example, the sealing member is a more rigid structure like a Belleville washer, the end 14*b* of the spacer preferably just fits over the sealing member 22 allowing for a small clearance between the sealing member and the inner surface 27*b* when the sealing member is not under any significant compression, so that axial compression of the sealing member will be required to effectuate the seal.

Figure 7:
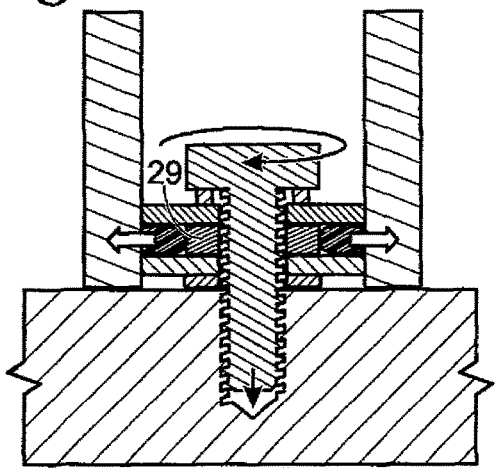
FIG. 7 is a cross-sectional side elevation of the spacer and foundation sub-assembly of FIG. 6 being manipulated to cause compression of a sealing member of the foundation sub-assembly against an internal surface of the spacer.

Now with reference to FIG. 7, with the spacer installed, the lag bolt 20 may be turned further so as to axially compress and thereby radially expand the diameter of the sealing member 22 as indicated by the double-arrows. If, for example, the sealing member is an O-ring, this turning provides for tightening the joint between the sealing member and the inner surface 27*b* of the spacer, to provide for structural rigidity. If, for example, the sealing member is a Belleville washer, this turning initially provides for creating a seal between the sealing member and the inner surface 27*b* of the spacer. Thereafter, additional turning is preferably provided for tightening the joint.

Referring back to FIG. 4 and with additional reference to FIG. 7, a compression bushing 29 is preferably provided in the foundation sub-assembly 12, between the washers 26*a* and 26*b* and inside of the sealing member 22, to provide a hard stop for tightening the lag screw 20 so as to axially compress the sealing member.

The internally threaded sub-assembly 16 includes an internally threaded member 17, a plug 19 comprising a threaded member 19*a* having a socket end 19*a*1 and an externally threaded end 19*a*2, and a sealing member 24 disposed so as to encircle the externally threaded end 19*a*2. The sealing member 24 has the same characteristics as the sealing member 22, and provides the same functionality.

The externally threaded end of the threaded member 19*a* is threaded into an internally threaded portion 17*a* of the internally threaded member 17. The threaded member 19*a* may be a standard socket head cap screw. With additional reference to FIGS. 8 and 9, the socket end 19*a*1 of the threaded member 19*a* is selected, adapted or configured so that it may interlockingly engage the head 20*a* of the lag bolt 20 of the form preparation sub-assembly 12, so as to allow for turning the bolt 20 by turning the threaded member 19*a*. A spacer bushing 21 may also be provided to increase the extension of the head 20*a* into the end 19*a*1.

Figure 8:
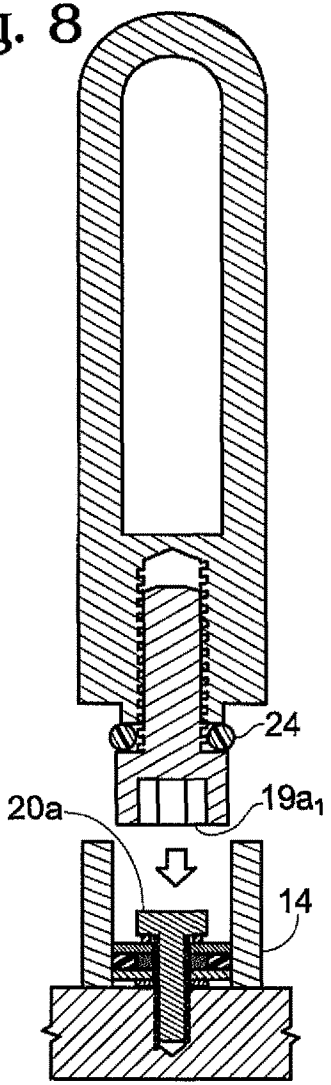
FIG. 8 is a cross-sectional side elevation showing an internally threaded sub-assembly according to the present invention being brought toward the foundation sub-assembly and spacer of FIG. 7.

Continuing with reference to FIGS. 8 and 9, the internally threaded sub-assembly 16 is brought toward the foundation sub-assembly 12 and spacer 14 such as indicated by the arrow in FIG. 8, to a resting position in which the head 19*a*1 of the internally threaded sub-assembly 16 interlockingly engages the head 20*a* of the lag bolt 20 as described above as shown in FIG. 9. Then, with specific reference to FIG. 9, turning the internally threaded member 17 as indicated by the arrow "A1" causes further turning of the threaded member 19*a* also as indicated above, which results in compressing and thereby radially expanding the diameter of the sealing member 24 as indicated by the double-arrows.

The internally threaded member is preferably, or at least it is typically, a ferrule loop insert, but it may be a threaded coil insert or any other hardware having internal threads and at least one open end for accessing them. While a ferrule loop insert has just one open end, it should be understood that an internally threaded member for use in the present invention may have more than one open end; accordingly, use of the term "open end" is not intended to imply that there is or must also be a closed end.

Figure 10:
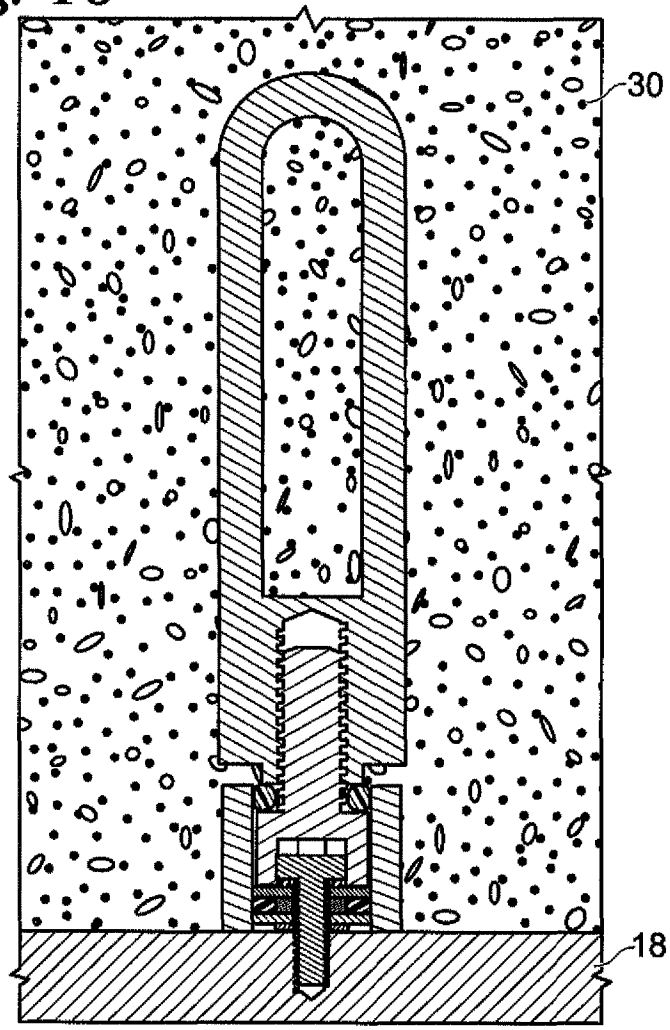
FIG. 10 is a cross-sectional side elevation showing a final disposition of the assembly of hardware of FIG. 4 buried within concrete that has been poured over the concrete form.
Figure 9:
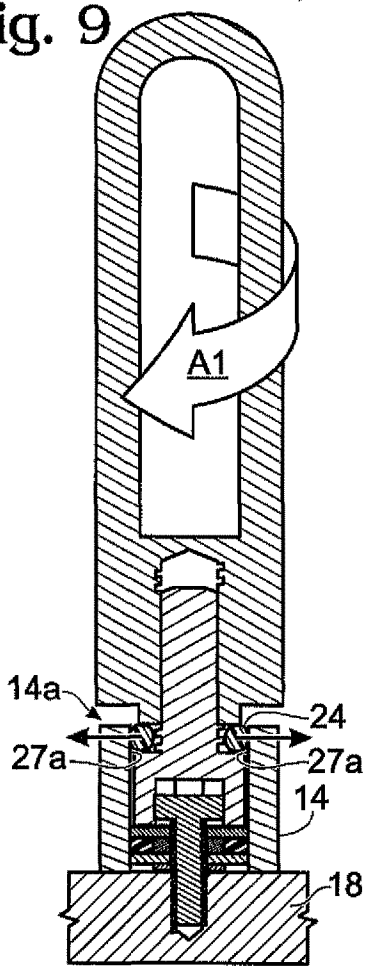
FIG. 9 is a cross-sectional side elevation showing the internally threaded sub-assembly of FIG. 8 in a resting position over the foundation sub-assembly and spacer of FIG. 7 and being manipulated to cause compression of a sealing member of a plug component of the internally threaded sub-assembly against an internal surface of the spacer.
Figure 12:
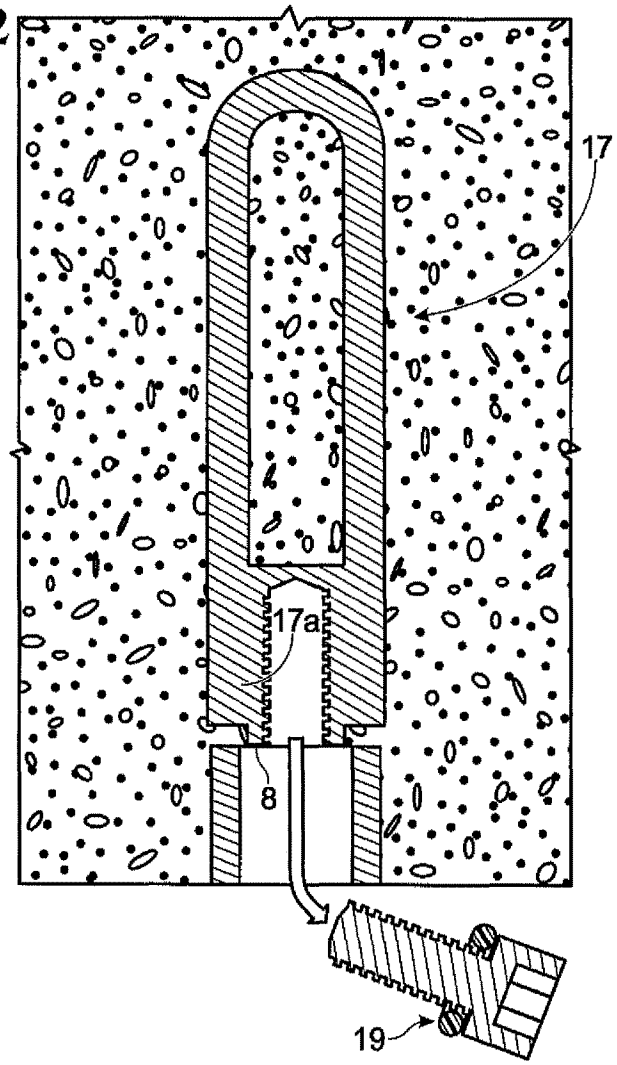
FIG. 12 is a cross-sectional side elevation of a finished concrete anchor point according to the invention, resulting from removing the plug from the internally threaded sub-assembly after the concrete form has been removed from the concrete as shown in FIG. 11.
Figure 11:
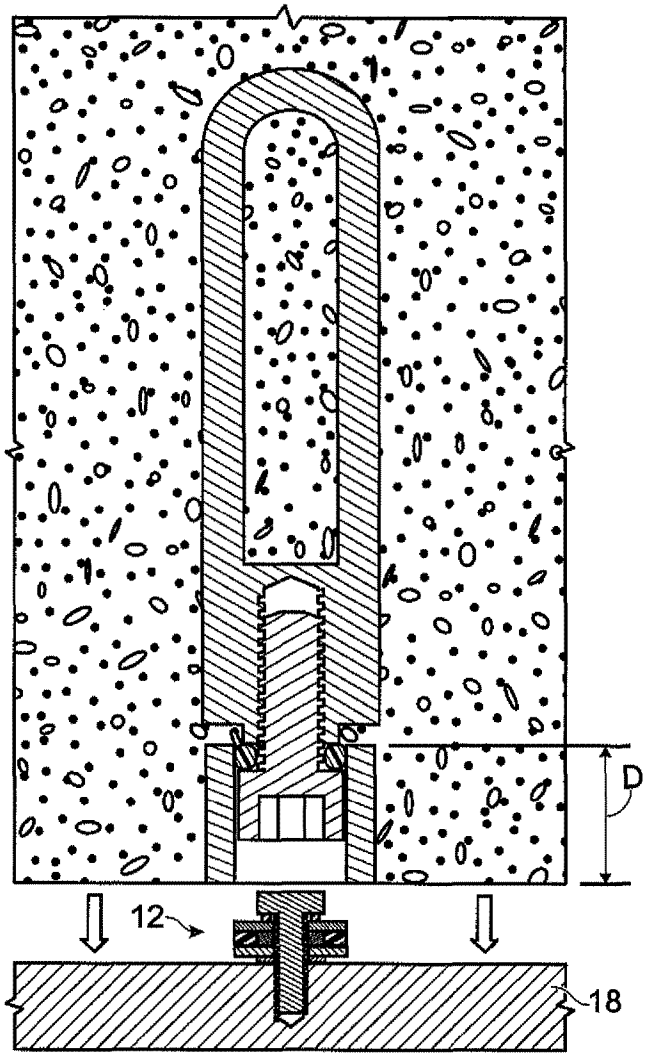
FIG. 11 is a cross-sectional side elevation showing the concrete form of FIGS. 5-10 being removed from the concrete after the concrete has cured.

In FIG. 10, wet concrete 30 is poured over the concrete form 18 and the assembly 10 as shown in FIG. 9 and allowed to cure, whereupon the form 18 may be removed as indicated in FIG. 11, taking with it the foundation sub-assembly 12 attached thereto, and with additional reference to FIG. 12, leaving the open end 8 of the internally threaded member 17*a* of the ferrule loop insert 17 being inset at a depth "D" from an exposed face 23 of the resulting volume of concrete.

The aforedescribed seals at the upper end and lower ends of the spacer are for sealing the spacer against wet concrete entering the spacer at the respective ends, for maintaining a through-hole in the volume of concrete extending from the opening in the exposed face to the open end of the internally threaded member.

Also, as explained above, tightening the joints established by the sealing members beyond that which may be required to effectuate a seal provides for structural rigidity, desirable for stiffening the final assembly 10 so that it is better able to withstand forces to which it may be inadvertently subjected before and during the time that the wet concrete is being poured around it.

The joint established by the sealing member 22 is broken simply by pulling (axially) the concrete form. Preferably this joint is tightened so that the force that will be required for this is not excessive, which could be of concern if there are multiple instances of the foundation sub-assembly 12 attached to one concrete form as is often the case. In consideration of this, this joint is preferably tightened to no more than about 100 pounds. On the other hand, this joint is also preferably tightened to at least about 80 pounds, and more preferably about 90 pounds, to provide for the desired structural rigidity. The compression bushing 29 advantageously provides for controlling the tightening force to be within these limits.

By contrast, there is generally no significant advantage to be gained by controlling the amount the joint associated with the sealing member 24 is tightened, beyond ensuring that it is not weaker than the joint associated with the sealing member 22, because the concrete form can be removed without breaking this joint. So in the preferred embodiment a compression bushing is omitted at this joint.

Finally, the plug 19 may be removed from the ferrule loop insert sub-assembly as shown in FIG. 12, leaving, as a result of maintaining the aforementioned through-hole, the internally threaded portion 17*a* of the ferrule loop insert available to receive attachment hardware for making structural attachment to the cured concrete as in the prior art. This can be for any purpose that such structural attachments have been provided in the prior art, typically for lifting a concrete panel or wall.

Figure 13:
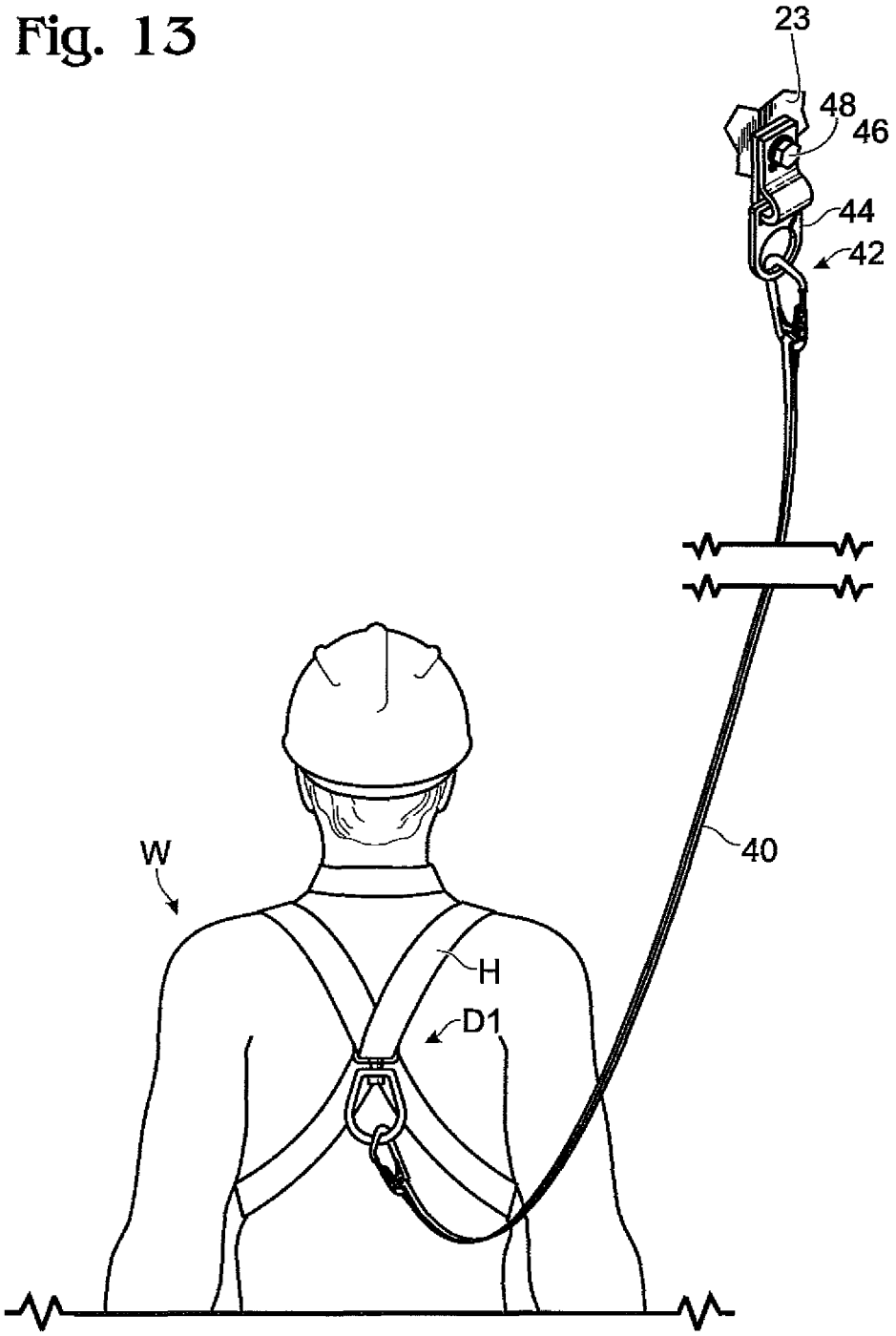
FIG. 13 is a pictorial illustration of the concrete anchor point of FIG. 12 being used to provide for fall protection according to the present invention.

Moreover, the present inventor has recognized that a concrete anchor point according to the invention may be used to provide for fall protection. An example is shown in FIG. 13, in which a worker "W" is shown wearing a harness "H" to which a D-ring "D1" such as the swiveling D-ring described in U.S. Pat. No. 8,973,705 is attached. A lanyard 40 connects the D-ring D1 to a carabiner 42, which in turn connects to another D-ring 44, which is connected to the concrete anchor point via a bracket 46 and bolt 48 that extends into the internally threaded portion 17*a* of the concrete anchor point 10.

The depth D in FIG. 12 as shown is equal to an overall length "L" of the spacer measured parallel to the hole 25, though such equality is not essential. Preferably, the depth D is substantially equal to or greater than ½ inch, which increases the size of the "shear cone" caused by the insert when it is loaded, for decreasing the stress on the concrete for a given loading, and thereby providing for a stronger connection.

The plug 9*b* in FIG. 3 has an undesirable characteristic that the end 8 of the ferrule 7 is typically much less than ½ inch, so that the shear cone is undesirably small. Both the plugs 9*a* of FIG. 2 and the plug 9*b* of FIG. 3 have an undesirable characteristic that they must be removed before the form can be removed from the cured concrete. And the plug 9*a* of FIG. 1 has an undesirable characteristic that it fails to robustly retain the ferrule loop insert in the desired orientation, perpendicular to the inner surface 2 of the form, before and during the time the concrete is being poured, when it is susceptible to being knocked over. The concrete anchor point 10 overcomes each of these undesirable characteristics of the prior art.

It is to be understood that, while a specific concrete anchor point and method for constructing same has been shown and described as being preferred, variations may be made, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. An anchor point in a volume of concrete having an end face and an opening therein, the anchor point comprising:

an anchoring member cast in the volume of concrete so as to provide sufficient anchoring strength to allow the anchoring point to be used to provide fall protection for a worker, the anchoring member having an anchoring end with a threaded anchoring hole therein;

a first spacer having two ends, a proximal end nearest the end face of the volume of concrete and a distal end nearest the anchoring end of the anchoring member, wherein the anchoring member and the first spacer are separate parts but are provided together in the volume of concrete, the first spacer having a hole therethrough extending from the opening in the end face to the threaded anchoring hole of the anchoring member, the first spacer functioning to space the threaded anchoring hole away from the end face at a non-zero depth within the volume of concrete; and a first sealing member disposed proximate one of the two ends of the first spacer, the first sealing member being formed of relatively compressible material as compared to the first spacer to provide for an enhanced relative deformation of the first sealing member at one or more points of first compressive contact between the first sealing member and the first spacer.

2. The anchor point of claim 1, wherein the first compressive contact between the first sealing member and the first spacer is inside the hole through the first spacer.

3. The anchor point of claim 2, further comprising a second sealing member disposed proximate the other of the two ends of the first spacer, the second sealing member being formed of relatively compressible material as compared to the first spacer to provide for an enhanced relative deformation of the second sealing member at one or more points of second compressive contact between the second sealing member and the first spacer.

4. The anchor point of claim 3, wherein the second compressive contact between the second sealing member and the first spacer is inside the hole through the first spacer.

5. The anchor point of claim 2, wherein the first sealing member is disposed proximate the distal end of the first spacer.

6. The anchor point of claim 5, wherein the first sealing member has a hole therethrough, the anchor point further comprising a first threaded member having a head portion and a threaded portion, the threaded portion of the first threaded member extending through the hole in the first sealing member and further threadingly extending into the threaded anchoring hole, thereby capturing the first sealing member between the head of the first threaded member, the anchoring end of the anchoring member, and the distal end of the first spacer, so as to create the first compressive contact.

7. The anchor point of claim 2, wherein the first sealing member is disposed proximate the proximal end of the first spacer.

8. The anchor point of claim 7, wherein the first sealing member has a hole therethrough, the anchor point further comprising a concrete form covering the end face of the volume of concrete, and a first threaded member having a head portion and a threaded portion, the threaded portion of the first threaded member extending through the hole in the first sealing member and further threadingly extending into the concrete form, thereby capturing the first sealing member between the head of the first threaded member, the concrete form, and the proximal end of the first spacer, so as to create the first compressive contact.

9. The anchor point of claim 8, further comprising a second sealing member disposed proximate the proximal end of the first spacer, the second sealing member being formed of relatively compressible material as compared to the first spacer to provide for an enhanced relative deformation of the second sealing member at one or more points of second compressive contact between the second sealing member and the first spacer.

10. The anchor point of claim 9, wherein the second compressive contact between the second sealing member and the first spacer is inside the hole through the first spacer.

11. The anchor point of claim 10, wherein the second sealing member has a hole therethrough, the anchor point further comprising a concrete form covering the end face of the volume of concrete, and a second threaded member having a head portion and a threaded portion, the threaded portion of the second threaded member extending through the hole in the second sealing member and further threadingly extending into the concrete form, thereby capturing the second sealing member between the head of the second threaded member, the concrete form, and the proximal end of the first spacer, so as to create the second compressive contact.

12. The anchor point of claim 11, further comprising a second spacer disposed inside the hole of the first sealing member, wherein the threaded portion of the first threaded member extends through a hole in the second spacer, the second spacer for limiting an amount of compressive force the head of the first threaded member can exert on the first sealing member to make the first compressive contact.

13. The anchor point of claim 10, further comprising a second spacer disposed inside the hole of the first sealing member, wherein the threaded portion of the first threaded member extends through a hole in the second spacer, the second spacer for limiting an amount of compressive force the head of the first threaded member can exert on the first sealing member to make the first compressive contact.

14. The anchor point of claim 9, further comprising a second spacer disposed inside the hole of the first sealing member, wherein the threaded portion of the first threaded member extends through a hole in the second spacer, the second spacer for limiting an amount of compressive force the head of the first threaded member can exert on the first sealing member to make the first compressive contact.

15. The anchor point of claim 8, further comprising a second spacer disposed inside the hole of the first sealing member, wherein the threaded portion of the first threaded member extends through a hole in the second spacer, the second spacer for limiting an amount of compressive force the head of the first threaded member can exert on the first sealing member to make the first compressive contact.

16. The anchor point of claim 7, further comprising a second spacer disposed inside the hole of the first sealing member, wherein the threaded portion of the first threaded member extends through a hole in the second spacer, the second spacer for limiting an amount of compressive force the head of the first threaded member can exert on the first sealing member to make the first compressive contact.

17. The anchor point of claim 7, wherein the proximal end of the first spacer is substantially flush with the end face.

18. The anchor point of claim 5, wherein the proximal end of the first spacer is substantially flush with the end face.

19. The anchor point of claim 3, wherein the proximal end of the first spacer is substantially flush with the end face.

20. The anchor point of claim 1, wherein the proximal end of the first spacer is substantially flush with the end face.

* * * * *